US006083057A

United States Patent [19]

Annecke et al.

[11] Patent Number: 6,083,057

[45] Date of Patent: Jul. 4, 2000

[54] ELECTRIC CONNECTOR

[75] Inventors: Alfred Annecke, Flein; Claus Dullin, Bad Rappenau, both of Germany

[73] Assignee: Amphenol-Tuchel Electronics GmbH, Germany

[21] Appl. No.: 09/133,815

[22] Filed: Aug. 13, 1998

[30] Foreign Application Priority Data

Aug. 14, 1997 [DE] Germany ..... 197 35 168

[51] Int. Cl.[7] ..... H01R 13/514

[52] U.S. Cl. ..... 439/752

[58] Field of Search ..... 439/752, 595

[56] References Cited

U.S. PATENT DOCUMENTS

| | | | |
|---|---|---|---|
| 5,299,958 | 4/1994 | Ohsumi | 439/752 |
| 5,389,014 | 2/1995 | Kumpel | 439/752 |
| 5,403,212 | 4/1995 | Aimasso | 439/752 |
| 5,409,405 | 4/1995 | Bungo | 439/752 |
| 5,518,334 | 5/1996 | Yagi et al. | 403/291 |
| 5,797,772 | 8/1998 | Sakurai et al. | 439/752 |
| 5,865,653 | 2/1999 | Okada et al. | 439/752 |

FOREIGN PATENT DOCUMENTS

| | | | |
|---|---|---|---|
| 0 814 541 | 12/1997 | European Pat. Off. | H01R 13/436 |
| 195 38 613 | 5/1996 | Germany | H01R 13/436 |
| 195 13 358 | 8/1996 | Germany | H01R 13/63 |
| 195 32 381 | 3/1997 | Germany | H01R 13/436 |
| WO 96/34429 | 10/1996 | WIPO . | |

*Primary Examiner*—Gary F. Paumen
*Assistant Examiner*—Alexander Gilman
*Attorney, Agent, or Firm*—Blank Rome Comisky & McCauley, LLP

[57] ABSTRACT

An electrical connector is arranged to be used with a counter plug, for example for use between a counter plug and an electrical control apparatus for an inflatable restraint system or airbag in a motor vehicle. The electrical connector includes a shell in which contacts are to be positioned and a locking member for locking the contacts in position. If the contacts are not properly positioned, the locking member cannot be pushed from a first catching position to a final catching position, and when the locking member is in the first catching position, the locking member is arranged to prevent insertion of the counter plug into the shell.

13 Claims, 2 Drawing Sheets

Section B-B

Section C-C

ELECTRIC CONNECTOR

BACKGROUND OF THE INVENTION

1. Field of the Invention

The invention concerns an electrical connector for use with a counter plug, for example for use between a counter plug and an electrical control apparatus for an air bag (an inflatable restraint system) in a motor vehicle.

2. Description of Related Art

Such a connector, wherein the counter plug is a component of a generator (a box with a squib), is the object of German Patent Publication DE 195 13 358 C1.

A connector of the generic type has a very Limited size (for example: diameter about 1.5 cm).

Therefore, both the manual and the mechanical assembly and packaging are problematic. Since motor vehicles are equipped with "air bags" in series in large scale manufacture today, there is a strong need to design the connector having a simple but safe construction.

An essential feature for safe construction is that the connector and the counter plug can be brought into contact only if the connector and the counter plug as well as the associated contacts are positioned exactly with respect to each other.

In the connector known from the DE 195 13 358 C1 a locking member is provided, which is formed as a sleeve being disposed coaxially with the shell and being displaceable axially on the shell.

SUMMARY OF THE INVENTION

It is the object of the invention to provide a connector of the said type, which, on the one hand, makes a pre-assembly (pre-catching position) possible and which, on the other hand, ensures that a contact with the counter plug is possible only when all the components are positioned exactly with respect to each other.

The invention is based on the knowledge that this becomes possible by a special formation of a locking member. The basic idea is to form the shell and the locking member in such a manner that the locking member can be placed upon the shell in two different catching positions (locking positions). Here, the first catching position is intended to provide a pre-catching position, in which the counter plug cannot be inserted into the connector, however. The putting-on of the counter plug is to be facilitated only in a second catching position in which is ensured at the same time that the cables and contacts are situated and retained securely within the shell.

The invention in its most general embodiment concerns an electrical connector for use with a counter plug, having the following features:

a shell being open towards the counter plug, for receiving electrical cables and contacts being situated at the open shell end in the mounting condition of the connector, a locking member which can be placed upon the shell, the shell and the locking member being formed in such a manner that in a first catching position with respect to the shell, the locking member diminishes the cross section of the shell opening with its first end so that the counter plug with its counter contacts cannot be brought to a contact position with the correspond ing shell contacts, and in a second catching position with respect to the shell, the first end of the locking member being arranged immersed within the shell.

The locking member may be pushed (placed) laterally upon the shell.

In other words, the locking member projects with its first end into the shell opening in a first catching position of the locking member so that the cross section of the shell opening becomes smaller and prevents the counter plug to be placed upon it.

In the second catching position, the locking member is pushed upon the shell so far that the first end of the locking member no longer projects into the shell opening. Now, the counter plug can be placed upon it and the connector and the counter plug can be brought into contact with each other. Now, the locking member can no longer be removed, it is secured in an unloseable manner.

While the locking member is brought from the first catching position to the second catching position, the first end of the locking member is guided correspondingly away from the open shell end into the shell body so that it does no longer interfere with the cross section of the shell opening.

In a constructive respect, the invention proposes different solutions for that:

According to a first embodiment, the locking member has at least one L-shaped projection at its first end, the free leg of which sticks out from the front portion of the locking member, in the direction of insertion.

Viewed from the side, the short L leg projects forwardly in the direction towards the shell opening. If the locking member is accordingly brought down laterally onto or into the shell via corresponding openings, the projecting leg of the projection is brought into the region of the shell opening.

In this embodiment, the shell has openings in the wall in the prolongation of the locking member displacement path, into which the free leg is inserted in further displacing the locking member with respect to the shell (second catching position).

Here, the L-shaped projection or projections ma y extend beside the shell contacts at the outside.

This embodiment provides a solution particularly if the section of the locking member is designed as a U shape. Accordingly, the L-shaped projections may then extend in the prolongation of the lateral U legs.

The description of the figures below explains the constructive design in detail.

Also, the locking member may be fixed to the shell in different ways.

Thus, it is possible to form the locking member having catch means directed inwardly on both sides at its second end on the front portion in the direction of insertion. Correspondingly, the shell has 2 corresponding catch seats in spaced apart relationship on both sides, respectively.

The first catch seats in the direction of insertion define the first catching position and the catch seats disposed behind thereof in the direction of insertion define the second catching position. Accordingly, the first and the second catching position may be reached in succession by pressing the locking member onto the shell laterally.

The design described above makes it possible to form further constructive and functional features and functions.

So, the locking member may be formed having several bridges extending in spaced apart relationship and parallel to each other, within the space being delimited by the lateral U legs.

For example, if three bridges are provided, five portions of the locking member extending parallel and in spaced apart relationship result together with the lateral U legs.

The framed (by the U legs) inner bridges have the following functions:

Neighbouring bridges may receive and guide or fix between themselves an associated contact.

In a preferred embodiment the outer bridges are disposed in the prolongation of the L-shaped projections towards the second end of the locking member and beside the shell contacts. If there are two contacts, another bridge will extend between the shell contacts so that each contact is delimited by a bridge on both sides.

By providing corresponding profile/bevelled surfaces of the free ends of the bridges a clamping fixation of the contacts and the associated cables can be obtained.

In another preferred embodiment, the shell is formed to have arms extending parallel to the shell contacts and resiliently biased towards the shell contacts.

It is intended that during assembly of the connector, the spring arms are pressed from the side against the contacts and fix them accordingly (primary locking of the contacts).

In order to secure the spring arms in the desired clamping position, the bridges (of the locking member) can be aligned to support the spring arms and thus the contacts in placing the locking member upon the shell up to the second locking position. Additionally, it is ensured in this way that the contacts are aligned exactly and are secured additionally (secondary locking of the contacts) in the second catching position (in which the connector is assembled completely) and now the counter plug may be put on. In this way, faulty contacts can be prevented.

In this sense, an embodiment provides an additional securing, in which the shell contacts are formed in an axial direction having at least two enlargements extending in spaced apart relationship.

The disposition and the distance of the enlargements is effected so that one of the enlargements is disposed in front of the above-mentioned clamping regions and the other enlargement directly behind them, in the assembled condition.

If a contact in this embodiment is by mistake not inserted far enough forwardly (in the direction of the shell opening), where it is situated against an abutment on the shell in his end position, for example, two alternatives result:

1.

Either the contact is displaced only slightly in backward direction. In this case, the locking member cannot be put on because the enlargement is situated in the displacement path of the bridges. This is recognized immediately by the engineer and he can insert the contact correctly.

2.

Also, it may occur that the contact is situated in the shell, displaced to the back for a considerable distance, that is "behind" the clamping region. In this case, the locking member may be inserted and brought into the second catching position. But now, the contact is situated so far in backward direction that, in putting-on the counter plug, contacting the contacts of the counter plug is no longer possible. Accordingly, this faulty position can be recognized immediately, too.

Finally, also a strain relief of the cables being situated within the shell can be obtained with the aid of the bridges and additional jaws, respectively.

For that, it is provided that the locking member has several bridges (jaws) extending parallel and in spaced apart relationship on its second end for clampingly fixing corresponding cable portions in the second catching position.

To this end, the surfaces of the jaws facing the cables can be formed with a profile, for example, so that they fix the corresponding cable portions with form fit and by static friction.

As arises from the aforesaid description of the invention, all the measures can be effected at the same time in placing the locking member upon the shell. This is also an essential aspect of the connector.

Since the locking member penetrates the shell partly upon being placed upon the shell, as arises from the description of the figures below, the structural shape of the connector may be small with an improvement of the safety functions at the same time which are of great importance especially in the field of application of "air bags", in order to facilitate and ensure the triggering of the air bag, if necessary.

Further characteristics follow from the features of the subclaims as well as the other application documents.

The invention will be described in more detail below with an embodiment.

BRIEF DESCRIPTION OF THE FIGURES OF DRAWINGS

Here, the figures show:

FIG. 1 an exploded view of a connector,

FIG. 2 a perspective view of the connector in a first catching position,

FIG. 3 a view in accordance with FIG. 2 in a second catching position,

FIG. 4 a longitudinal section through the connector in accordance with FIG. 3, FIG. 5*a* a section along line B—B along the first catching position in accordance with FIG. 2, FIG. 5*b* a section along line B—B along the first catching position in accordance with FIG. 3, FIG. 6 section along line C—C in accordance with FIG. 4, FIG. 7 a longitudinal section in accordance with FIG. 4 with a contact inserted incorrectly.

In principle, the connector consists of the following components:

DETAILED DESCRIPTION OF THE PREFERRED EMBODIMENT

A shell 10 having a shell opening 12, a locking member 30 having a U-shaped section, and cables 50, 52 with contacts 50*k*, 52*k* at their free end.

Figure 1:
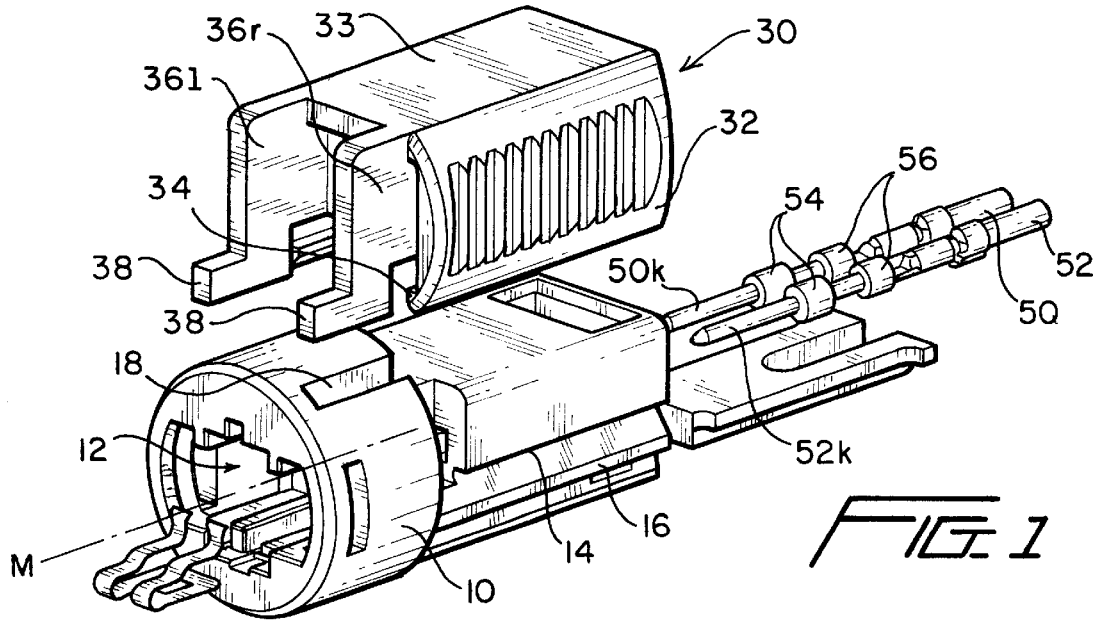

The shell 10 has a cylindrical shape at its left end 121 in FIG. 1 and has essentially a rectangular cross section at its other end 12*r*, two catch edges 14, 16 being formed in axial direction M of the connector on the portion 12*r* on either side.

These catch edges 14, 16 serve for receiving the locking member (slide) 30, the lateral U legs of which are indicated at 32. The U legs 32 are offset inwardly at their free ends. Catch means 34 are formed thereby corresponding to the catch edges (catch seats) 14, 16.

At a first end 321 (on the left in FIG. 1), L-shaped projections 361, r are visible in the prolongation of the U legs 32. The free legs 38 project to the left in the figure.

Slots 18 are formed in the front shell portion 121, corresponding to the legs 38. In placing the locking member 30 upon the shell 10, the projections 36, 38 thereof are inserted into the slots 18. At the same time, the U legs 32 of the locking member 30 are first pushed radially to the outside at the rear shell end 12*r* to catch then with their catch means 34 behind the corresponding catch edges 14 and thus to define the first catching position (FIG. 2).

Figure 2:
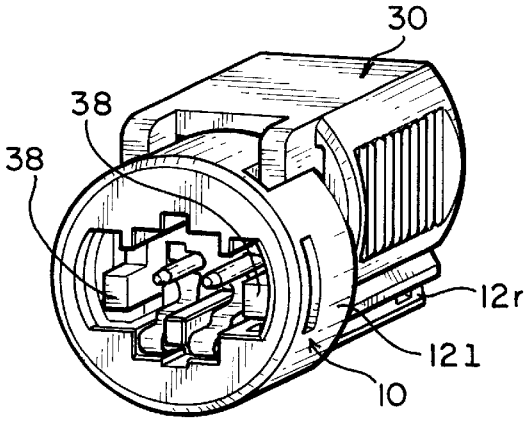

As is shown in FIG. 2, the legs 38 project into the shell opening 12 and reduce the cross section. Now, it is not possible—according to the object—to put on a counter plug.

At this time, the cables 50, 52 are already assembled within the shell 10.

The cables 50, 52 are situated in the rear shell portion 12*r* within guides at the bottom and their contacts 50*k*, 52*k* project into the open shell portion 121. The exact positioning results from the view of FIG. 1 together with that of FIG. 4 (for the second catching position).

Each of the contacts 50*k*, 52*k* has two enlargements 54, 56 being spaced apart in axial direction. The front enlargements 54 are situated in the shell portion 121 and the rear enlargements 5 6 are situated in the shell portion 12*r*.

This positioning is supported and facilitated by the following features:

In the region between the shell portions 121, 12*r*, a bridge 40 extends between the projections 36, 38 and the U legs 32, respectively.

At the free end of the shell portion 12*r*, three jaws 42*a, b, c* extend from the connecting leg 33 of the locking member 30, that is substantially parallel to the U legs 32.

In this manner, guiding slots for the cables 50, 52 and the contacts 50*k*, 52*k*, respectively, are formed between the projections 361, r and the bridge 40 and between the jaws 42*a, b, c*, respectively.

Figure 4:
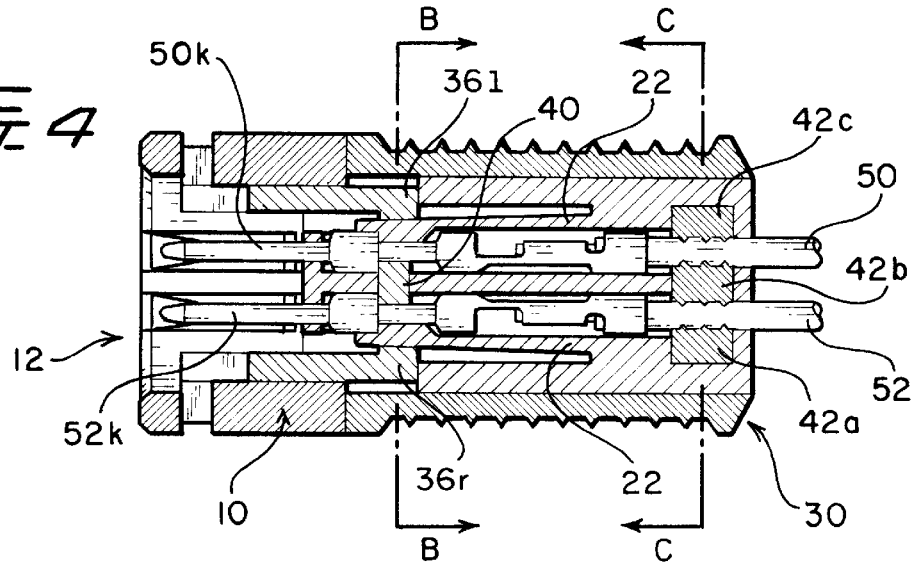

FIG. 4 shows the reception of the cables 50, 52 between the jaws 42*a* to *c* with form-fit in the assembled condition of the connector.

In the region of the bridge 40, the shell 10 is formed having lateral spring arms 22 extending in axial direction M of the connector and project—as shown in FIG. 4—towards the shell portion 121 beyond the region of the projections 36, 38. In inserting the contacts 50*k*, 52*k*, the spring arms 22 are pushed away to the sides as soon as the enlargements 54, 56 run against them. Then, the arms 22 spring back (primary locking of the contacts).

Figure 5A:
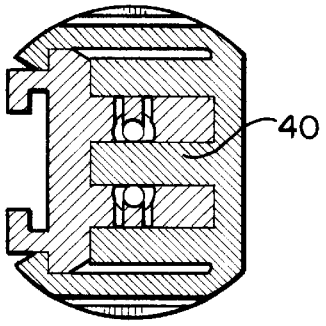
Figure 5B:
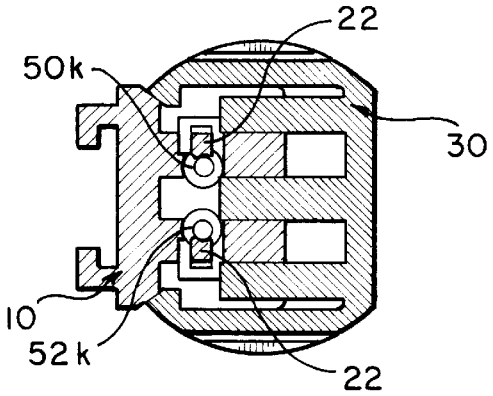
Figure 6:
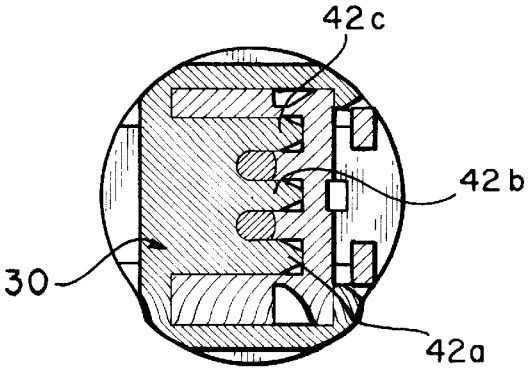

In pushing the locking member 30 to the second catching position (in which the catch means 34 spring behind the catch edges 16), the projections 361, r support the spring arms 22 to the exterior and clamp the contacts 50*k*, 52*k* between the spring arms 22 and the bridge 40 (FIGS. 4, 5*b*).

If the contact has slipped so that one of the enlargements 54, 56 is situated between the projections 36, 38 and the bridge 40, the locking member 30 cannot be put on. It follows that a final assembly of the connector is possible only when the cables 50, 52 and the contacts 50*k*, 52*k* are positioned exactly (FIG. 4) or have slipped so far that the enlargements 54, 56 are no longer situated in the transverse plane defined by the bridge 40.

Figure 7:
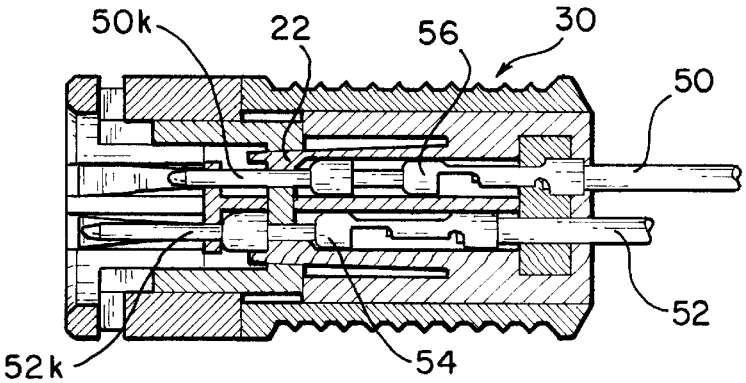

In the last-mentioned case, the contact has slipped—as shown in FIG. 7—so far to the back that no contacting is possible after putting-on the counter plug.

Figure 3:
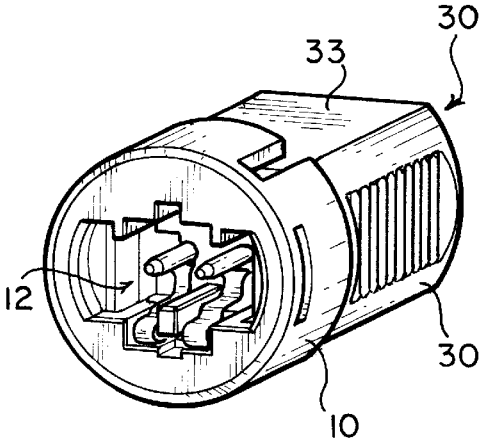

FIG. 3 shows the connector in the second catching position of the shell 10 and the locking member 30. Here, the legs 38 extend within cavities 13 on the shell and the shell opening 12 is free for putting-on the counter plug. In that case, the counter plug locks the legs 38 so that the locking member cannot be pulled (upwardly) from the housing 10. Also, the locking member cannot be removed in a backward direction (axially) because the legs 38 are retained within the corresponding seats in the shell.

We claim:

1. An electrical connector for use with a counter plug, comprising:

a shell having an opening at a first end for receiving the counter plug, and a second end through which electrical contacts are inserted to a final contact position within said shell;

a locking member arranged to be placed upon said shell and moved, while on said shell, from a first catching position to a second catching position, wherein said locking member can only be moved from said first catching position to said second catching position when said electrical contacts are properly positioned in said contact position, movement of said locking member from said first catching position to said second catching position locking said electrical contacts in said final contact position, and wherein when said locking member is in said first catching position, said locking member extends into said opening towards said first end of said shell and thereby decreases a size of said opening to prevent said counter plug from being inserted into said shell.

2. The connector according to claim 1, wherein the locking member includes catch means directed inwardly on both sides of said locking member, and said shell includes corresponding catch edges for engaging said catch means in order to lock said locking member on said shell when said locking member is in said second catching position.

3. The connector according to claim 1, wherein the shell includes arms extending parallel to said electrical contacts, said arms being resiliently biased towards engagement with said electrical contacts, whereby when said locking member is in said second catching position, said locking member prevents said arms from disengaging said electrical contacts to thereby lock said electrical contacts in said shell.

4. The connector according to claim 1, further comprising bridge members which engage said arms to prevent said locking member from being moved to said second catching position when said electrical contacts are improperly positioned.

5. The connector according to claim 1, wherein the electrical contacts include enlarged sections spaced apart in an axial direction of the electrical contacts.

6. The connector according to claim 1, wherein the electrical contacts are connected to cables and said locking member includes a plurality of spaced apart inner jaws extending parallel to each other, said inner jaws being arranged to clamp said cables when said locking member is moved to said second catching position.

7. The connector according to claim 1, wherein the locking member is arranged such that the locking member can no longer be removed from the shell when said locking member is moved to said second catching position and after said counter plug has been inserted into said opening.

8. The connector according to claim 1, wherein the locking member has at least one L-shaped projection at a first end, a free leg of the L-shaped projection extending outwardly from the first end of the locking member into said opening for receiving the counter plug.

9. The connector according to claim 8, wherein the at least one L-shaped projection extends alongside said contacts adjacent an outside edge of said opening.

10. The connector according to claim 8, wherein the locking member includes at least one outer bridge extending from said L-shaped projections alongside said electrical contacts towards an end of said locking member when said electrical contacts are in said final contact position, and at least one further bridge extending between said electrical contacts when said electrical contacts are in said final contact position.

11. The connector according to claim 1, wherein the locking member has a U-shaped cross-section when viewed from a direction of insertion of the counter plug into said opening.

12. The connector according to claim 11, wherein the locking member includes a plurality of bridges extending between sides of said locking member in spaced apart relationship and in parallel to each other, said bridges being arranged to prevent said locking member from being moved to said second position when said electrical contacts are improperly positioned.

13. The connector according to claim 12, wherein bridges include at least one outer bridge extending alongside said electrical contacts towards an end of said locking member when said electrical contacts are in said final contact position, and at least one further bridge extending between said electrical contacts when said electrical contacts are in said final contact position.

* * * * *